United States Patent [19]

Haida et al.

[11] 4,263,043

[45] Apr. 21, 1981

[54] DESULFURIZING AGENT FOR INJECTION

[75] Inventors: Osamu Haida; Toshihiko Emi; Sumio Yamada; Fumio Sudo; Hiraku Sonoda, all of Chiba, Japan

[73] Assignee: Kawasaki Steel Corporation, Kobe, Japan

[21] Appl. No.: 119,124

[22] Filed: Feb. 6, 1980

[30] Foreign Application Priority Data

Feb. 15, 1979 [JP] Japan ..... 54-16509

[51] Int. Cl.[3] ..... C21C 7/02

[52] U.S. Cl. ..... 75/58; 75/53

[58] Field of Search ..... 75/53, 60, 58

[56] References Cited

U.S. PATENT DOCUMENTS 3,954,446 5/1976 Miyaoka ..... 75/53

3,984,236 10/1976 Koenig ..... 75/53

4,014,685 3/1977 Jones ..... 75/53

*Primary Examiner*—P. D. Rosenberg

*Attorney, Agent, or Firm*—Balogh, Osann, Kramer, Dvorak, Genova & Traub

[57] ABSTRACT

A desulfurizing agent for injection mainly consisting of lime powders having a particle diameter which allows at least 50 wt. % of the lime powders to pass through a screen mesh of 100 μm and containing 0.015 to 1.0 wt. % of silicone oil surfactant, 10 to 40 wt. % of carbonate or hydroxide of alkaline earth metal, and 2 to 20 wt. % of carbon. The desulfurizing agent further contains 2 to 10 wt. % of at least one fluoride selected from the group consisting of fluoride of alkaline metal, fluoride of alkaline earth metal, cryolite, and sodium silicofluoride.

6 Claims, 5 Drawing Figures

DESULFURIZING AGENT FOR INJECTION

BACKGROUND OF THE INVENTION

1. Field of the Invention

This invention relates to an injection desulfurizing agent suitable for use in injection desulfurization treatment of hot metal.

2. Description of the Prior Art

Steel having a good quality has recently been strongly required. Particularly, sulfur in steel conspicuously deteriorates steel products in mechanical property, and hence, it is desirous to make the sulfur content in the steel as low as possible. To meet the requirement, it has been the common practice to subject the desulfurization treatment to the hot metal bath.

The desulfurizing agent suitable for the desulfurization of the hot metal has been investigated for long. At present, desulfurizing agents mainly consisting of calcium carbide ($CaC_2$) are widely used owing to the reasons that such desulfurizing agents are high in reaction efficiency and are relatively easy in removing slag therefrom after the desulfurization treatment.

The calcium carbide, however, consumes much amount of electric power in the course of manufacture and hence is expensive. In addition, the use of the calcium carbide has the disadvantage that there is a risk of acetylene gas being produced during handling. As a cheaper desulfurizing agent, sodas such as sodium carbonate have also been used. These sodas tend to produce white smoke during the desulfurization treatment and hence is troublesome in operation. In addition, these sodas increase a melting loss of the refractory lining of a desulfurization treating vessel. Thus, such desulfurizing agent has not widely been used.

It has also been known that lime is considerably less expensive than carbide and sodas and has a sufficiently large desulfurizing capacity. Thus, it has long been tried to use the lime as the desulfurizing agent. The quick lime has the advantage that acetylene and white smoke are not generated, but has the important drawback that the desulfurization reaction is slow. As a result, the addition of much amount of quick lime has been required in order to make the desulfurization rate large. The use of such much amount of quick lime ensures an increase of the cost of the desulfurizing agent if compared with that of the carbide or sodas even though the desulfurizing agent per se is less expensive. In addition, the use of such much amount of lime induces the temperature drop during the desulfurization treatment and also increases the loss of hot metal into resulting slag. Thus, the lime is not used in practice.

Many methods of desulfurizing hot metal have also been investigated and use in practice. Recently, a method of injecting desulfurizing agent together with a carrier gas into the pig iron bath in a torpedo car through a lance has often been used.

This method has the advantage that a large amount of molten bath can be treated within a short time. But, the desulfurization reaction occurs within a short time elapsed from the injecting of the desulfurizing agent to the rising up thereof to the surface of the hot metal bath, and as a result, use must be made of a desulfurizing agent having a high reaction rate. Lime having a low reaction rate is not suitable for use as the desulfurizing agent for injection.

However, the lime is less expensive, easy in handling and not dangerous and hence has been appraised as a useful desulfurizing agent.

In order to improve the reaction efficiency of the lime used for the injection desulfurization, a method of making the particle diameter of the lime powders small so as to increase the interfacial reaction area or a method of adding a small amount of fluorspar or the like to the lime so as to make a portion of the lime low in its melting point, has been proposed.

SUMMARY OF THE INVENTION

In the present invention, in order to investigate the effect of the conventional methods proposed as above described, experimental tests in which nitrogen is used as a carrier gas and lime desulfurizing agents which are different in particle diameter of lime and in fluorspar content are blown into a hot metal bath in a torpedo car have been carried out.

The above experimental tests have shown the result that the desulfurization reaction efficiency of the lime becomes more or less changed depending on the particle diameter of the lime powders or on the fluorspar content, that such amount of change is small, and that the above conventional methods are not effective owing to the fact these methods become expensive by the pulverization expense necessary for making the particle diameter small and by the addition of the fluorspar which is more expensive than the lime.

A desulfurizing agent mainly consisting of lime with 1 to 15% of $CaCO_3$ remained therein by lowering the degree of calcination, has also been proposed. Such conventional method, however, has the disadvantage that the desulfurization effect of the insufficiently burnt lime used as the injection desulfurizing agent is inferior to that of the well burnt lime.

An object of the invention, therefore, is to provide a lime desulfurizing agent which can exhibit a high reaction efficiency even when it is used in an injection desulfurization treatment.

A feature of the invention is the provision of a desulfurizing agent for injection mainly consisting of lime powders having a particle diameter which allows at least 50 wt.% of the lime powders to pass through a screen mesh of 100 $\mu$m and containing 0.015 to 1.0 wt.% of silicone oil surfactant, 10 to 40 wt.% of carbonate or hydroxide of alkaline earth metal, and 2 to 20 wt.% of carbon. The desulfurizing agent according to the invention may further contain 2 to 10 wt.% of at least one fluoride selected from the group consisting of fluoride of alkaline metal, alkaline earth metal, cryolite and sodium silicofluoride.

Lime powders are inferior in fluidity and has a density which is larger than that of carbide. As a result, in the case of effecting the injection desulfurization, the use of a small amount of carrier gas provides the disadvantage that the lance is clogged with the lime powders, and that lime powders tend to induce a heavy pulsating flow, thereby rendering the injection impossible.

Such disadvantage can be eliminated by increasing the amount of carrier gas by the order of 70 l per 1 kg of the desulfurizing agent. The use of such increased amount of carrier gas makes it possible to inject the lime powders, but the amount of spattering the hot metal bath during the injection of the lime powders becomes large. Also, much amount of carrier gas makes the speed of the ascending flow of the hot metal considerably high and makes the floating up time of the injected desulfurizing agent to the surface of the hot metal bath extremely short. Therefore, a sufficient desulfurization effect could not be attained especially for the lime which exhibits a low desulfurization rate. This makes the desulfurizing insufficient.

In the invention, in order to eliminate the above mentioned disadvantage, many experimental tests and investigations have been carried out which have demonstrated the result that the use of the silicone oil treatment ensures an improvement to the fluidity of the line powders and permits the injection operation to effect with a high solid (the desulfurizing agent) to gas (carrier gas) ratio, and that the addition of suitable amount of additives provides a blown desulfurizing agent which is less expensive and has a high desulfurization effect.

DETAILED DESCRIPTION OF THE PREFERRED EMBODIMENTS

Figure 1:
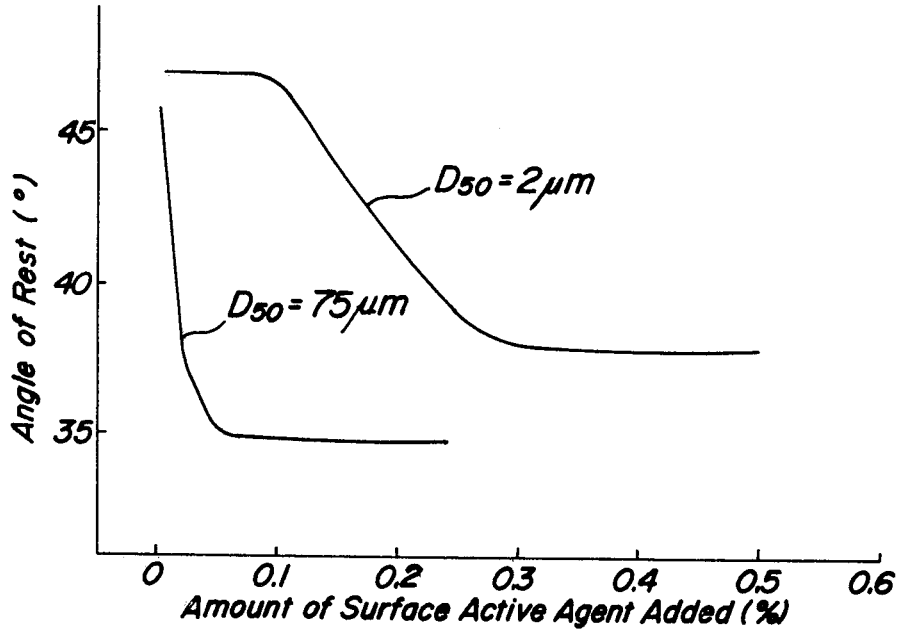
FIG. 1 is a graph illustrating a relation between a silicone oil surfactant, methylhydrogen polysiloxane, added to two kinds of lime powders whose particle diameters are different from each other and a rest angle.

FIG. 1 shows change of fluidity of lime powders when a small amount of silicone oil surfactant is added thereto. FIG. 1 shows change of an angle of rest measured as a standard of the fluidity of two kinds of lime powders uniformly added with methylhydrogen polysiloxane which is one kind of silicone oil, where these two kinds of lime powders have particle diameters $D_{50}$, which is defined as the screen mesh to allow 50 wt.% of the lime powders to pass through, of 2 μm and 75 μm, respectively.

As seen from FIG. 1, the addition of a small amount of methylhydrogen polysiloxane results in a considerably large reduction in the angle of rest, thereby significantly improving the fluidity of the lime powders. As a result, it is possible to inject the desulfurizing agent with the aid of a small amount of carrier gas of the order of 10 l per 1 kg of the desulfurizing agent.

In this case, it is preferable to add such amount of surfactant that the angle of rest becomes about at most 40°. The required amount of the surfactant is dependent on the particle diameter of the lime powders. If the particle diameter of the lime powders lies within a range defined by the invention, it is necessary to use at least 0.015 wt.% of the surfactant.

The upper limit of the concentration of the surfactant to be added is not limited in view of the effect of improving the fluidity of the lime, but it is preferable to determine the upper limit to the order of 1% from the economical point of view.

Concerning about 100 μm-mesh screens, Japanese Industrial Standard JIS Z 8801 defines that 145 mesh is used to designate a size of screen having openings of 105 μm, U.S. Standard ASTME defines that 140 mesh is used to designate a size of screen having openings of 105 μm. British Standard BS 410 defines that 150 mesh is used to designate a size of screen having openings of 104 μm, and U.S. Tyler Standard defines that 150 mesh is used to designate a size of screen having openings of 104 μm.

Many experimental tests on the desulfurization effect of a lime desulfurizing agent treated by the surfactant so as to improve the fluidity thereof have been carried out.

The experimental tests have demonstrated the result that if the lime is mixed with carbonate of alkaline earth metal such as $CaCO_3$ or hydroxide of alkaline earth metal such as $Mg(OH)_2$ and carbon such as pitch coke, oil coke, graphite, electrode chips, anthracite, charcoal or the like, the desulfurization effect becomes remarkably improved, and that if fluoride such as $CaF_2$, NaF, $MgF_2$, cryolite ($Na_3AlF_6$), sodium silicofluoride or the like, are further added to the above mixture, the desulfurization effect is further improved and at the same time is stabilized.

The mechanism of improving the desulfurizing effect of the quick lime by the addition of the above mentioned substances is not yet clearly known, but it has been found out that the desired objective can be attained if the composition of the desulfurizing agent lies within a range to be described in greater detail. It has heretofore been considered preferable to decrease the oxygen potential of the carrier gas as low as possible in order to use the lime for the injection desulfurization. The reason has been considered that oxygen in the carrier gas reacts wit Si in the hot metal bath to produce $SiO_2$ that tends to cover the surface of the lime, thereby retarding the reaction rate. In order to reduce the oxygen potential use has eventually been made of natural gas as carrier gas. Carbonate or hydroxide of alkaline earth metals such as $CaCO_3$and $Mg(OH)_2$ produce $CO_2$ and $H_2O$ in the hot metal bath, respectively. It is expected that $CO_2$ and $H_2O$ thus produced react with Si to produce $SiO_2$ in the same manner as oxygen. Therefore, the conventional lime desulfurizing agent for injection has not practically been mixed with the above mentioned substances. In spite of the above mentioned experiences and considerations, the invention has demonstrated the surprising result that if lime is mixed with $CaCO_3$ and $Mg(OH)_2$, the desulfurization effect of the lime can be improved.

But, mere addition of carbonate or hydroxide of alkaline earth metal and carbon and eventually fluoride such as $CaF_2$, NaF, $MgF_2$, $Na_3AlF_6$, $Na_2SiF_6$ to lime does not lead to the above described desired effect. The conditions required for obtaining proper mixed ratio and particle diameter of the lime must be satisfied and fluidity of lime must be improved by treating it by the surfactant.

Figure 2:
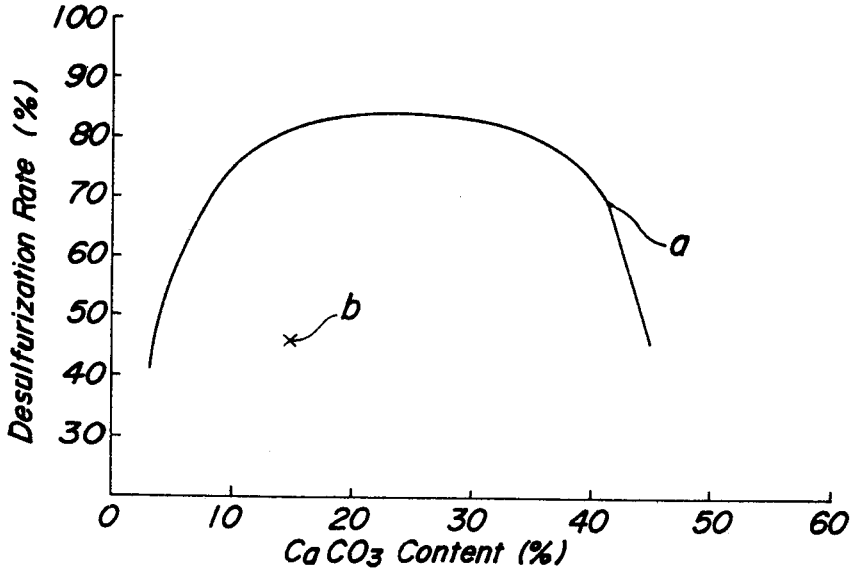
FIG. 2 is a graph illustrating a relation between $CaCO_3$ content and a desulfurization rate of a desulfurizing agent having a composition of CaO—$CaCO_3$-10%C-0.05% methylhydrogen polysiloxane.
Figure 3:
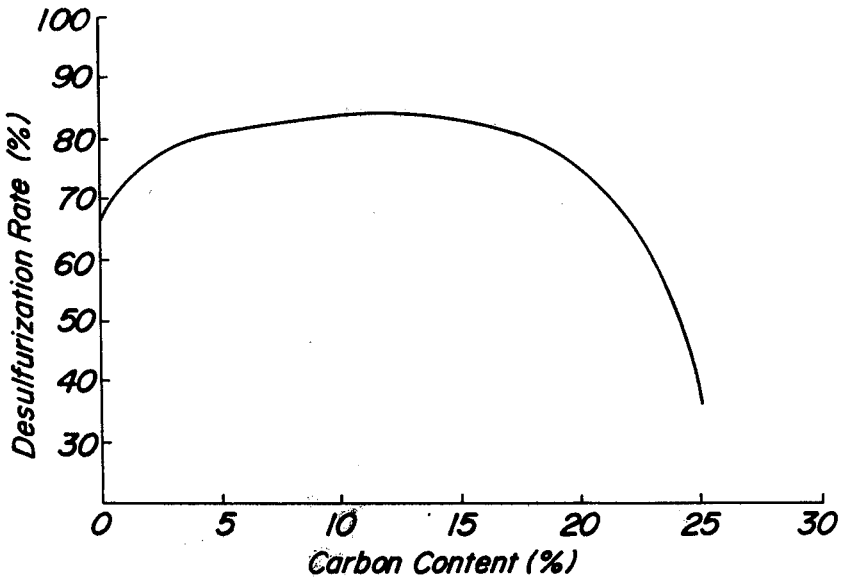
FIG. 3 is a graph illustrating a relation between carbon content and desulfurization rate of a desulfurizing agent having a composition of CaO-25% $CaCO_3$—C-0.05 methylhydrogenpolysiloxane.
Figure 4:
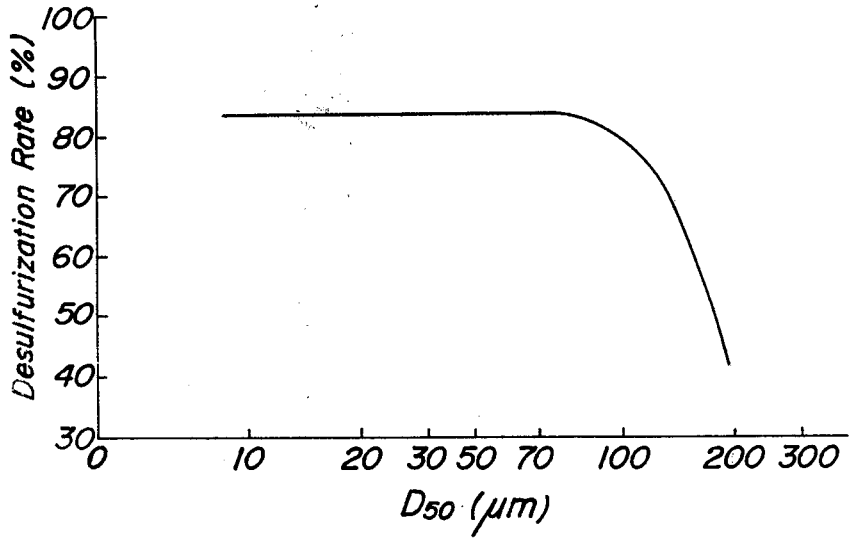
FIG. 4 is a graph illustrating a relation between a particle diameter and desulfurization rate of a desulfurizing agent according to the invention and having a composition of CaO-25% $CaCO_3$-10%-0.015 to 0.4% methylhydrogen polysiloxane.

These conditions will now be described. FIGS. 2 to 4 show the result obtained by injecting 6 kg of desulfurizing agent per 1 ton of hot metal bath into 200 to 300 tons of the hot metal bath containing sulfur whose concentration is about 0.040% before the desulfurization treatment.

FIG. 2 shows a relation between the content of gas generating substance such as $CaCO_3$ or $Mg(OH)_2$ or the like in the desulfurizing agent and the desulfurization rate. In FIG. 2, a curve a shows change of the desulfurization rate as a function of the change of $CaCO_3$ content within a range from 3% to 45% in a desulfurizing agent manufactured by mixing a well burnt lime (CaO) with lime stone powders ($CaCO_3$) and carbon powders and having a composition of CaO—$CaCO_3$-10% C-0.05% methylhydrogen polysiloxane. In FIG. 2, symbol ×b shows a desulfurization rate obtained by injecting a desulfurizing agent manufactured by mixing a poor burnt lime powders containing 15% of $CaCO_3$ and carbon and having a composition of CaO-15% $CaCO_3$-10% C-0.05% methylhydrogen polysiloxane. As seen from FIG. 2, the result showm by ×b is smaller in the desulfurization rate than the result shown by the curve a.

As shown by the curve a shown in FIG. 2, if the $CaCO_3$ content is less than 10%, the amount of gas generated due to decomposition of $CaCO_3$ becomes small and hence the desulfurization rate becomes small, while if the $CaCO_3$ content exceeds 40%, the ratio of $CaCO_3$ having substantially no desulfurizing capacity becomes large and hence the desulfurization ratio becomes small. As a result, a suitable amount of $CaCO_3$ to be added is limited to 10 to 40%. Particularly, in the case of using $CaCO_3$, the lime stone powders and the lime powders must be mixed separately. It has been found out that even when use is made of carbonate or hydroxide of the other alkaline earth metal a range within the content of 10 to 40% thereof has an excellent desulfurization effect.

FIG. 3 shows a relation between a carbon content in the desulfurizing agent and the desulfurization rate. The cause why the desulfurization rate becomes increased as the carbon content is increased is not clear. But, it would be considered that the carbon functions to make the atmosphere reducing and react with $CO_2$ and $H_2O$ generated from $CaCO_3$ and $Mg(OH)_2$, respectively, so as to increase the amount of generated gas as given by the following formulae (1) and (2).

$$CO_2 + C \rightarrow 2CO \quad (1)$$
$$H_2O + C \rightarrow H_2 + CO \quad (2)$$

If the carbon content is less than 2%, the above mentioned function of the carbon is not sufficiently exhibited and hence the desulfurization rate is small. On the contrary, if the carbon content exceeds 20%, the carbon per se has no desulfurizing power and hence the desulfurization ratio becomes significantly lowered. As seen from the above, it is preferable to use a carbon content within a range of 2 to 20%.

As described above, it is suitable that the desulfurizing agent has a composition within a range mainly consisting of lime and containing 10 to 40% of the other gas generating substance and 2 to 20% of carbon. Even though the desulfurizing agent has a composition within the above mentioned range, if the particle diameter $D_{50}$ of the lime powders is large, the desulfurization ratio becomes small. FIG. 4 shows a relation between the particle diameter $D_{50}$ of the lime and its desulfurization rate. If the particle diameter $D_{50}$ of the lime powders, which is the mesh openings allowing 50 wt.% of the lime powders to pass through exceeds 100 μm, the contact area of the lime powders with the hot metal bath becomes small and hence the desulfurization rate is rapidly decreased. As a result, the particle diameter $D_{50}$ must be smaller than 100 μm for the purpose of improving the desulfurization ability.

As seen from the above, it is possible to obtain a desulfurizing agent for injection having a significantly high desulfurization effect if the desulfurizing agent mainly consists of lime having a particle diameter, which allows at least 50 wt.% of the lime to pass through the screen mesh of 100 μm and mixed with 10 to 40% of carbonate or hydroxide of alkaline earth metal and 2 to 20% of carbon and uniformly added with 0.015 to 1.0% of silicone oil surfactant.

It has been found out that the desulfurization rate is remarkably stabilized if the above mentioned composition is further added with 2 to 10% of fluoride of alkaline metal or alkaline earth metal such as $CaF_2$, NaF, $MgF_2$, cryolite or sodium silicofluoride or the like.

Figure 5:
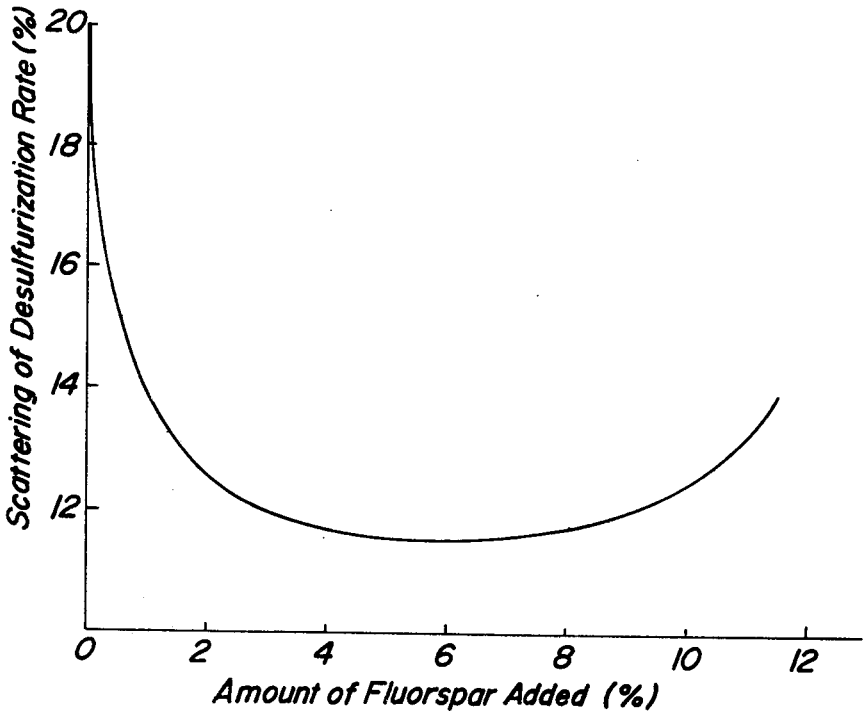
FIG. 5 is a graph illustrating a relation between an amount of fluorspar ($CaF_2$) added and scattering of desulfurization rate of desulfurizing agent according to the invention and having a composition of CaO-25% $CaCO_3$-10%—$CaF_2$-0.05% methylhydrogen-polysiloxane.

FIG. 5 shows a relation between an amount of fluorspar added and scattering of desulfurization rate. As seen from FIG. 5, the use of 2 to 10% of $CaF_2$ added to lime ensures a remarkable decrease in scattering of the desulfurization rate.

The large scattering of the desulfurization rate results in an excessive lowering of the concentration of sulfur after the desulfurization operation, that is, an excessive use of the desulfurizing agent. Alternatively, the large scattering results in an excessively high concentration of sulfur that requires an extra redesulfurization operation, thereby making the desulfurization operation expensive. As a result, the addition of the fluoride for the purpose of stabilizing the desulfurization ratio is very beneficial and also functions to make the desulfurization rate high by the order of 2 to 3%. In order to exhibit these effects, at least 2% of fluoride must be added to the desulfurizing agent. If the amount of fluoride added exceeds 10%, but only the improvement of the desulfurization rate and the effect of stabilizing the desulfurization rate are slightly decreased, but also the desulfurizing agent becomes expensive. As a result, the amount of fluoride to be added is made within a range between 2% and 10%.

Practical examples which make use of desulfurizing agents having preferred compositions within a range according to the invention will now be described if compared with comparative examples which make use of desulfurizing agents having compositions lying out of the range according to the invention.

PRACTICAL EXAMPLES NOS. 1 TO 8 AND COMPARATIVE EXAMPLES NOS. 9 TO 15

In these examples, use was made of compositions of a desulfurizing agent, particle diameter of lime, presence or absence of silicone oil treatment and amount of carrier gas per 1 kg of the desulfurizing agent as listed in the following Table 1. In these examples, use was made of nitrogen gas as a carrier gas and respective desulfurizing agents were injected into 200 to 300 tons of hot metal bath. The amount of the desulfurizing agents used was determined to 6 kg per 1 ton of the hot metal bath for all of these examples.

TABLE 1(a)

| | No. | Composition of desulfurizing agent (wt. %) CaO | C | $CaCO_3$ | Remainder | Particle diameter of lime, $D_{50}$ (mm) | Addition of silicone oil | Amount of carrier gas (l/kg) |
|---|---|---|---|---|---|---|---|---|
| | 1 | 65 | 10 | 25 | — | 15 | added (0.05 wt. %) | 10 |
| | 2 | 65 | 10 | — | $Ca(OH)_2 + Mg(OH)_2$: 25 | 15 | " | 10 |
| Practical | 3 | 65 | 10 | — | $MgCO_3$: 25 | 15 | " | 10 |
| example | 4 | 62 | 10 | 25 | $CaF_2$: 3 | 15 | " | 10 |
| | 5 | 62 | 10 | 25 | NaF: 3 | 15 | " | 10 |
| | 6 | 62 | 10 | 25 | $MgF_2$: 3 | 15 | " | 10 |
| | 7 | 62 | 10 | 25 | $Na_3AlF_6$: 3 | 15 | " | 10 |
| | 8 | 62 | 10 | 25 | $Na_2SiF_6$: 3 | 15 | " | 10 |

TABLE 1(b)

| | No. | Composition of desulfurizing agent (wt. %) CaO | C | $CaCO_3$ | Remainder | Particle diameter of lime, $D_{50}$ (mm) | Addition of silicone oil | Amount of carrier gas (l/kg) |
|---|---|---|---|---|---|---|---|---|
| | 9 | 85 | 10 | 5 | — | 15 | added (0.05 wt. %) | 60 |
| | 10 | 45 | 10 | 45 | — | 15 | " | 10 |
| Compara- | 11 | 75 | — | 25 | — | 15 | " | 10 |
| tive | 12 | 55 | 25 | 20 | — | 15 | " | 10 |
| example | 13 | 65 | 10 | 25 | — | 150 | " | 10 |
| | 14 | 90 | 10 | — | — | 15 | not added | 70 |
| | 15 | 65 | 10 | 25 | — | 15 | not added | 70 |

The desulfurization treatment was subjected to the hot metal bath under the conditions listed in the above Table 1 and concentration of sulfur before and after the desulfurization treatment, desulfurization rate and scattering of the desulfurizing rate thus obtained were measured. The result is shown in the following Table 2.

TABLE 2

| | No. | Concentration of sulfur (wt. %) Before desulfurization treatment | After desulfurization treatment | Desulfurization rate (%) | Scattering of desulfurization rate (%) |
|---|---|---|---|---|---|
| | 1 | 0.041 | 0.007 | 83 | 19 |
| | 2 | 0.038 | 0.006 | 84 | 18 |
| Practical | 3 | 0.040 | 0.007 | 83 | 19 |
| example | 4 | 0.041 | 0.006 | 85 | 11 |
| | 5 | 0.039 | 0.005 | 87 | 12 |
| | 6 | 0.041 | 0.006 | 85 | 12 |
| | 7 | 0.042 | 0.006 | 86 | 11 |
| | 8 | 0.041 | 0.006 | 85 | 12 |
| | 9 | 0.040 | 0.018 | 55 | 26 |
| Compara- | 10 | 0.039 | 0.021 | 46 | 19 |
| tive | 11 | 0.040 | 0.013 | 68 | 26 |
| example | 12 | 0.041 | 0.025 | 39 | 20 |
| | 13 | 0.039 | 0.021 | 46 | 28 |
| | 14 | 0.041 | 0.018 | 56 | 24 |

As seen from Table 1, in the comparative examples No. 14 and No. 15 in which the silicone oil is not used, 70 l/kg of carrier gas was required for the purpose of preventing the lance from being clogged with the desulfurizing agent. Particularly, in the comparative example No. 15 , $CO_2$ gas generated from $CaCO_3$ was added to the carrier gas to violently splash the hot metal bath, thereby making the hot metal bath flowing out from an outlet of the torpedo car. As a result, it was impossible to continue the injection operation.

As seen from Table 2, in the comparative examples Nos. 9, 10, 11 and 12 in which $CaCO_3$ or C content is out of the preferred range according to the invention and in the comparative example No. 13 in which the particle diameter of CaO is larger than the preferred particle diameter according to the invention, the desulfurization ratio becomes small and in addition the scattering of the desulfurization rate is large.

On the contrary, as seen from the practical examples shown in the above Table 2, the use of the desulfurization agent according to the invention ensures a considerably high desulfurization rate if compared with that of the comparative examples. Particularly, as seen from the practical example Nos. 4 to 8, the addition of fluoride such as $CaF_2$, NaF, $MgF_2$, $Na_3AlF_6$, $Na_2SiF_6$ or the like makes the scattering of the desulfurization rate small, thereby effectively carrying out the desulfurization treatment in a stabilized manner.

The desulfurizing agent according to the invention can also be added to hot metal bath during oxygen blowing in a converter or to steel bath after the oxygen blowing operation.

As stated hereinbefore, the invention is capable of using a cheap lime desulfurizing agent when hot metal bath in a torpedo car or ladle is subjected to injection desulfurization treatment and hence capable of significantly reducing the cost required for such desulfurization treatment.

In addition, the desulfurizing agent according to the invention is simple in handling and there is not risk of acetylene gas being generated which has been encountered with the conventional carbide desulfurizing agent and there is no risk of white smoke being generated which has been encountered with the conventional soda desulfurizing agent and hence is not detrimental to health.

What is claimed is:

1. A desulfurizing agent for injection consisting essentially of lime powders having a particle diameter which allows at least 50 wt.% of the lime powders to pass through a screen mesh of 100 μm and containing 0.015 to 1.0 wt.% of silicone oil surfactant, 10 to 40 wt.% of carbonate of alkaline earth metals and 2 to 20 wt.% of carbon.

2. The desulfurizing agent according to claim 1 and further containing 2 to 10 wt.% of at least one fluoride selected from the group consisting of fluoride of alkaline metal, fluoride of alkaline earth metal, cryolite, and sodium silicofluoride.

3. A desulfurizing agent for injection consisting essentially of lime powders having a particle diameter which allows at least 50 wt.% of the lime powders to pass through a screen mesh of 100 μm and containing 0.015 to 1.0 wt.% of silicone oil surfactant, 10 to 40 wt.% of hydroxide of alkaline earth metals and 2 to 20 wt.% of carbon.

4. The desulfurizing agent according to claim 3, and further containing 2 to 10 wt.% of at least one fluoride selected from the group consisting of fluoride of alkaline metal, fluoride of alkaline earth metal, cryolite, and sodium silicofluoride.

5. The desulfurizing agent according to claim 1, in which said carbonate of alkaline earth metals is $CaCO_3$ being used as a gas generating substance.

6. The desulfurizing agent according to claim 3, in which said hydroxide of alkaline earth metals is $Mg(OH)_2$ being used as a gas generating substance.

* * * * *